US008783359B2

(12) United States Patent
Reed

(10) Patent No.: US 8,783,359 B2
(45) Date of Patent: Jul. 22, 2014

(54) APPARATUS AND SYSTEM FOR PROCESSING SOLIDS IN SUBSEA DRILLING OR EXCAVATION

(75) Inventor: Larry D. Reed, Spring, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 314 days.

(21) Appl. No.: 12/898,425

(22) Filed: Oct. 5, 2010

(65) Prior Publication Data

US 2012/0080186 A1 Apr. 5, 2012

(51) Int. Cl.
*E21B 43/00* (2006.01)
*E21B 17/18* (2006.01)

(52) U.S. Cl.
USPC ..... 166/357; 166/350; 166/367; 166/267; 166/345; 175/102; 175/207; 241/36; 241/257.1

(58) Field of Classification Search
USPC ..... 175/5, 25, 55, 84, 206, 207; 166/344, 166/345, 354, 358, 367; 241/36, 357.1
See application file for complete search history.

(56) References Cited

U.S. PATENT DOCUMENTS

| | | | | |
|---|---|---|---|---|
| 4,291,772 | A | 9/1981 | Beynet | |
| 4,366,928 | A * | 1/1983 | Hughes | 241/30 |
| 4,373,592 | A * | 2/1983 | Dellinger et al. | 175/61 |
| 4,813,495 | A | 3/1989 | Leach | |
| 4,892,258 | A * | 1/1990 | Hughes | 241/79.3 |
| 6,102,673 | A | 8/2000 | Mott et al. | |
| 6,216,799 | B1 | 4/2001 | Gonzalez | |
| 6,230,824 | B1 | 5/2001 | Peterman et al. | |
| 6,263,981 | B1 | 7/2001 | Gonzalez | |
| 6,325,159 | B1 * | 12/2001 | Peterman et al. | 175/7 |
| 6,328,107 | B1 | 12/2001 | Maus | |
| 6,394,195 | B1 | 5/2002 | Schubert et al. | |
| 6,415,877 | B1 | 7/2002 | Fincher et al. | |
| 6,474,422 | B2 | 11/2002 | Schubert et al. | |
| 6,527,054 | B1 * | 3/2003 | Fincher et al. | 166/357 |
| 6,530,437 | B2 | 3/2003 | Maurer et al. | |
| 6,571,873 | B2 | 6/2003 | Maus | |
| 6,648,081 | B2 | 11/2003 | Fincher et al. | |

(Continued)

FOREIGN PATENT DOCUMENTS

| | | |
|---|---|---|
| WO | WO2007139581 | 12/2007 |
| WO | WO2008151128 | 12/2008 |

OTHER PUBLICATIONS

Eggemeyer, J. C. et al., SPE 71359; "Subsea Mudlift Drilling; Design and Implementation of a Dual Gradient Drilling System", Society of Petroleum Engineers Inc, 2001, 13 pages.

(Continued)

*Primary Examiner* — James Sayre
(74) *Attorney, Agent, or Firm* — John E. Vick

(57) ABSTRACT

An apparatus, system and method is disclosed for processing geological solids or wellbore cuttings generated by excavation or drilling under a body of water. An apparatus for processing solids in association with a riser may employ a solids processing apparatus having a central cavity that is substantially free of mechanical obstructions. The central cavity may be positioned in-line with the riser. The apparatus may be adapted for receiving solids within the central cavity and reducing the particle size of the solids by action of a cutter assembly which is positioned outside of the central cavity. The cut and processed solids may be pumped to the surface of the water.

11 Claims, 6 Drawing Sheets

(56) References Cited

U.S. PATENT DOCUMENTS

| | | | | |
|---|---|---|---|---|
| 6,668,943 | B1 | 12/2003 | Maus et al. | |
| 6,745,857 | B2 | 6/2004 | Gjedebo | |
| 6,802,379 | B2 | 10/2004 | Dawson et al. | |
| 6,854,532 | B2 | 2/2005 | Fincher et al. | |
| 6,926,101 | B2 | 8/2005 | deBoer | |
| 7,027,968 | B2 | 4/2006 | Choe et al. | |
| 7,114,581 | B2 | 10/2006 | Aronstam et al. | |
| 7,134,498 | B2 | 11/2006 | Hopper | |
| 7,159,669 | B2 | 1/2007 | Bourgoyne et al. | |
| 7,270,185 | B2 | 9/2007 | Fontana et al. | |
| 7,490,672 | B2 * | 2/2009 | Hollier | 166/357 |
| 2002/0108782 | A1 | 8/2002 | Boer | |
| 2003/0070840 | A1 * | 4/2003 | Boer | 175/5 |
| 2004/0065440 | A1 | 4/2004 | Farabee et al. | |
| 2008/0105434 | A1 | 5/2008 | Orbell et al. | |
| 2008/0302570 | A1 | 12/2008 | deBoer | |
| 2009/0314544 | A1 | 12/2009 | Humphreys | |
| 2010/0147593 | A1 * | 6/2010 | Hariharan et al. | 175/66 |

OTHER PUBLICATIONS

Smith, K. L. et al., SPE 71357; "Subsea Mudlift Drilling Joint Industry Project: Delivering Dual Gradient Drilling Technology to Industry", Society of Petroleum Engineers Inc, 2001, 13 pages.

International Search Report for PCT/US11/053586 dated Jun. 19, 2012, 6 pages.

* cited by examiner

APPARATUS AND SYSTEM FOR PROCESSING SOLIDS IN SUBSEA DRILLING OR EXCAVATION

FIELD OF THE INVENTION

The field of the invention is directed to apparatus, systems and methods for processing solids or cuttings generated by excavation or drilling under a body of water.

BACKGROUND

In oil and gas exploration and mining industries it is sometimes useful to process solids or cuttings that are excavated or drilled from geological deposits below a body of water. In subsea drilling, for, example, it is possible to remove drilled cuttings from the ocean floor using subsea pumps that return to the surface geological solids entrained in drilling mud.

One difficulty associated with such processes is the tendency of solids undesirably to plug or block processing apparatus, including pumps and flow conduits. In some cases, blockage is due to the excessive size of the solids particles. In other instances the nature of the solids may cause them to adhere to processing equipment, flow conduits or cutting blades, which may result in blockage or shutdown of operations. When a blockage occurs it is costly and time consuming to clear the blockage.

United States patent published application US 2010/0147593 A1 is directed to a subsea solids processing unit having a housing with cutters for reducing the size of solids entrained in a drilling mud.

A publication entitled "SubSea MudLift Drilling Joint Industry Project: Delivering Dual Gradient Drilling Technology to Industry", Society of Petroleum Engineers, SPE 71357 (2001: Annual Technical Conference and Exhibition, New Orleans, La.) describes the use of a horizontally offset mudlift pump and solids handling mechanism. FIG. 5 illustrates the use of a horizontally offset mudlift pump that is offset some distance from the drill pipe and riser assembly. Solids entrained in drilling mud first are transported by a flow conduit away from the drill pipe and riser for processing. Then, the solids are pumped by way of a return line to the water surface.

Another publication, "SubSea MudLift Drilling: Design and Implementation of a Dual Gradient Drilling System", Society of Petroleum Engineers, SPE 71359, (2001: Annual Technical Conference and Exhibition, New Orleans, La.) describes the use of a solids processing unit (SPU) integrated into a Subsea Mudlift Drilling (SMD) system deployed in connection with a very large 185,000 pound mudlift pump (MLP) package.

A significant challenge in the drilling of wells over water is to reduce time and effort in deploying equipment into the water to prepare for and conduct drilling operations. It is desirable to deploy equipment that may be easily and conveniently placed in the water from an mobile offshore, drilling unit, or MODU. Furthermore, in the processing and transportation of drilled cuttings for operations conducted in water it is desirable to reduce the likelihood of forming undesirable blockages within mud/solids flow conduits and a solids processing unit. In general, the total length of a conduit and the number of angles or turns in a flow conduit increases the likelihood of a blockage within a conduit. Further, it is known that various types of debris may be transported a solids, processing unit, and it is desirable to reduce the likelihood of blockage within a solids processing device. Certain types of soil are known to have a tendency to adhere to processing equipment, which in some instances could cause a flow blockage. It would be desirable to devise a reliable and effective method for cleaning the inside of a subsea solids processing apparatus without removing the unit from the water, and pulling the unit out of service.

SUMMARY OF THE INVENTION

The invention in one particular embodiment is a solids processing apparatus including a drilling riser load path aligned inner sleeve having a central cavity and a housing shell positioned circumferentially outside the inner sleeve to form a peripheral annulus region between the shell and the inner sleeve. The central cavity typically is free from mechanical obstruction to allow drilling tools, casing strings, fluids and solids to freely pass through the central cavity. A first cutter assembly may be provided within the peripheral annulus region. The first cutter assembly may include a first shaft having one or more blades. An intake aperture may be provided in fluid communication with the central cavity. The intake aperture may be adapted for transferring drilling mud and solids to the central cavity. A redundant drain port arrangement may be configured for expelling drilling mud and processed solids from the peripheral annulus region. In some embodiments of the invention the apparatus provides a second cutter assembly comprised of a second shaft having additional blades. The first and second shafts are aligned generally parallel, and the first and second shafts are configured for counter-rotation. A third and a fourth cutter assembly also may be employed within the peripheral annulus region of the apparatus. One or more of the cutter assemblies may be held, as a unit in the form of a self contained cassette assembly. Also, one or more of the cutter assemblies may be, adapted to receive power from a drive mechanism positioned outside the housing shell. In a subsea application, the apparatus may be configured for direct connection to a drilling riser. One additional feature may include the central cavity being adapted for receiving a washing tool extended from the rig on drill pipe through the annulus of the drilling riser. In an inline configuration, the apparatus may include a load bearing inner sleeve configured for receiving and transferring mechanical load forces during deployment, retrieval and operational connected modes of operation in drilling a deepwater well.

In yet another embodiment of the invention, a system for processing drilled solids is provided. The system may be deployed within a body of water having an upper water surface and a lower mudline surface. The system may include a riser extending below the water surface, the riser being filled with a first fluid having a first density. A wellbore extending below the mudline surface may be filled with a second fluid of a second density. The second density is greater than the first density. A fluid separation mechanism may be employed in communication with the riser and the wellbore. The fluid separation mechanism, sometimes referred to as a subsea rotating device (SRD), may be adapted for maintaining separation and differential density between the first and second fluids. Also, a subsea mud lift pump may be employed in the case of dual gradient drilling application of the invention. A solids processing apparatus is connected to the mudlift pump. The solids processing apparatus has a central cavity, the central cavity being positioned in-line with the riser and adapted for receiving drilled solids in the central cavity. The solids processing apparatus is configured for reducing the particle size of the drilled solids to form processed solids. The solids processing apparatus, in one embodiment of the invention, includes a pressure rating at least as great as the pressure rating of the drilling riser. Typically, a redundant drain port arrangement connects the solids processing apparatus to the mud lift pump. The processed solids are transported from the solids processing apparatus to the mud lift pump through the drain ports. In a useful embodiment, the solids processing apparatus includes an inner sleeve surrounding the central cavity and a housing shell positioned circumferentially outside of the inner sleeve. A peripheral annulus region in the solids processing apparatus may be provided between the inner sleeve and the housing shell. At least one cutter assembly is positioned in or adjacent to the peripheral annulus region. The solids processing apparatus also includes an intake aperture in communication with the central cavity. The intake aperture is adapted for transferring drilled solids to the solids processing apparatus. One advantageous embodiment of the invention employs an inner sleeve that is load bearing, that is, capable of receiving and transferring the substantial heavy load as deployed with the drilling riser system.

The cutter assemblies may include rotating shafts in a generally parallel configuration. In the practice of the invention, paired shafts may be configured for counter-rotation which aids in the movement of drilling mud and solids debris through the solids processing apparatus. One or more of the cutter assemblies may be mounted in a first cassette. Multiple cassettes may provided in the peripheral annulus region of the solids processing apparatus, and each cassette may include one or more cutting assemblies with blades. The cutting assemblies may be powered by a hydraulic mechanism connected to a mudlift pump. In one embodiment, the solids processing apparatus is capable of sustaining at least 3.5 million pounds of axial load and may be designed to accommodate additional loads as water depth impacts continue to increase in the industry.

One aspect of the invention may be characterized as a method of processing solids within a body of water, using a riser extending below the water surface. The riser may be filled with a first fluid having a first density. A wellbore extends below a mudline surface and is filled with a second fluid of a second density. The second density is greater than the first density. To accommodate fluids of differing density, a fluid separation mechanism (such as an SRD) may be connected to the riser and in fluid communication to the wellbore. The fluid separation mechanism may be adapted for maintaining, a differential density between the first and second fluids. In the practice of the method, a solids processing apparatus having a central cavity is positioned in-line with respect to the fluid separation mechanism. This solids processing apparatus is capable of transporting solids from the wellbore to the interior space of the solids processing apparatus and reducing the size of the solids. Then, processed solids are expelled from the apparatus. In most instances, expelled processed solids are provided to a mudlift pump. Then, the solids are pumped to the water surface. In one method of the invention it is possible to extend a wash tool through the riser into the central cavity of the solids processing apparatus to remove solids from the interior of the apparatus.

BRIEF DESCRIPTION OF THE FIGURES

The Figures illustrate various aspects of the invention, including the following.

DETAILED DESCRIPTION

In the deployment of the invention, it is desirable to employ a solids processing apparatus that is adapted and configured for use inline with a riser. The system of the invention may also include a mudlift pump (MLP) operating in-line with the riser. However, it is recognized that the invention could be deployed with a mudlift pump that is not inline with the riser. The invention could be deployed from an offshore drilling platform or a drilling ship or any other structure capable of supporting a drill string. Furthermore, the invention could be employed in undersea mining operations.

For purposes of this disclosure, "dual gradient drilling" or "DGD" refers to a drilling technique employing a seawater-filled return line in a portion of the riser. DGD is a drilling technique designed to address the problem of excess downhole pressures in a wellbore. That is, the significant difference between the pressure of the hydrostatic, head of drilling mud in a riser and the pressure of the formation at points adjacent to the mudline presents a challenge. This, pressure differential may cause operational difficulties that prevent drilling a well to its target depth using conventional riser return drilling methods. DGD drilling employs a riser filled with seawater, which limits the pressure imbalance. To employ DGD techniques, there is a need to create an interface between the drilling mud in the wellbore (or wellhead) and the seawater in the riser. This interface may be a fluid-fluid interface, located generally above the wellhead in the riser, or may be implemented by employment of a mechanical device to provide positive isolation of the two fluids.

The subsea rotating device (SRD) that may be employed in the system of the invention is some respects analogous to a drilling rotating head. It is the uppermost piece of equipment in the DOD drilling system. It is typically deployed approximately about sixty (60) feet above the mudlift pump (MLP), but its precise placement depends upon the configuration of the well. The SRD serves to separate the roughly 8.6 pounds per gallon fluid in the riser from the higher weight density mud in the well. The SRD assists to prevent gas from entering the riser, and provides a slight pressure on the well (less than 50 psi) needed to feed the MLP.

It should be noted that the invention disclosed herein may be employed with dual gradient drilling, but the invention is not necessarily limited to use in dual gradient drilling. That is, the apparatus, system or methods of the present invention could be deployed effectively in connection with conventional single gradient drilling or any other process that would benefit from the reduction in particle size of drilled cuttings in an effective manner. Furthermore, it is recognized that the invention could be employed in connection with excavation processes in subsea mining and the like in which solids are processed to reap the mineral content of mined solids.

Figure 1:
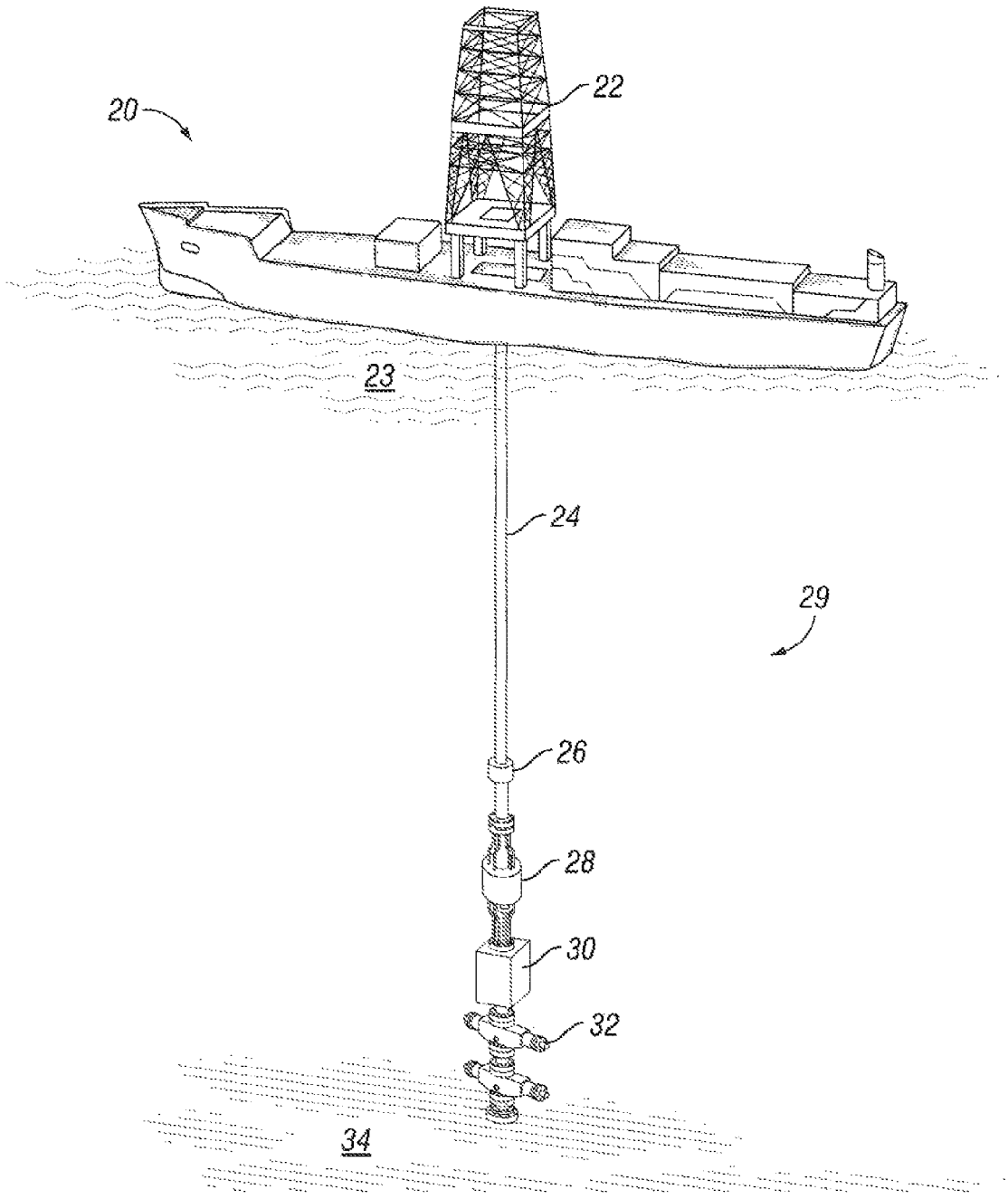
FIG. 1 shows the system for processing drilled solids within a body of water.

Referring to FIG. 1, the invention for well drilling applications may be deployed in one embodiment in connection with a drillship 20 upon which rests a rig 22. A riser 24 extends within the drill string 29 from the rig into a body of water 23 towards the mudline 34. The riser 24 is operatively connected to a subsea rotating device 26. The solids processing apparatus or unit (SPU) 28 may be located below the SRD and inline with the SRD or inline with the riser. A mudlift pump 30 may be located inline with the drill string as well. A blowout preventer (BOP) 32 is shown in FIG. 1 positioned upon the mudline 34 (or sea floor, in the case of ocean drilling).

As used in this specification, the term "inline" or "in-line" refers generally to the positioning of a component within a drill string 29 as a component of the drill string 29, as opposed to a position detached (or only remotely connected) to the drill string 29. A drill string 29 refers to a column of generally vertical strand of drill pipe within a riser that transmits drilling fluid (via mud pumps) and torque (by the top drive and kelley; not shown) to a drill bit at bottom hole (not shown).

Figure 2:
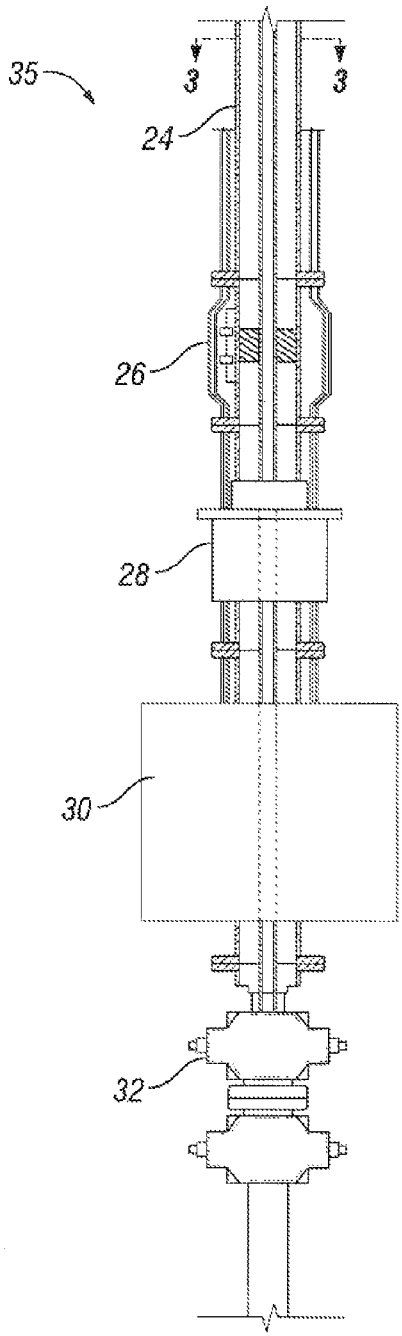
FIG. 2 illustrates several components extending from the riser to the mudline.
Figure 3:
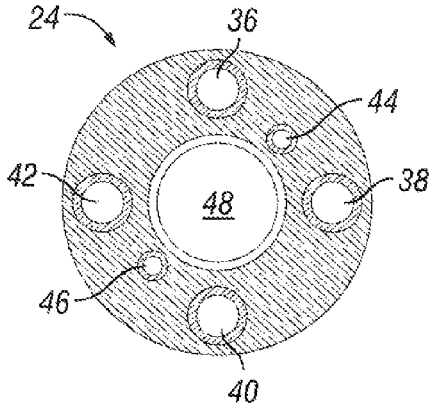
FIG. 3 reveals a cross-section of the riser taken along line 3-3 of FIG. 2.

In FIG. 2, a portion 35 the drill string 29 is shown which includes a riser 24, subsea rotating device 26, solids processing apparatus 28, mudlift pump 30 and blow out preventer 32. A cross-section of the riser taken along line 3-3 of FIG. 2 is seen in FIG. 3. In FIG. 3 seawater power line 40 carries seawater from the drillship 20, which serves as a power source for the mudlift pump 30. Seawater is employed to power the mudlift pump 30, and such seawater typically will be filtered to about 100 microns. A mudlift pump 30 that may be used in the practice of the invention with dual gradient drilling is manufactured by the Hydril Company of Houston, Tex.

The mud descent line 48 (which is the space occupied by the drillpipe, not shown) forms the central area of riser 24. A mud return line 36 carries mud and processed solids (i.e. drilled cuttings) back to the surface to drillship 20. A kill line 38 also is shown, which functions to provide a clean fluid line to surface for the initial gauging of a kick pressure impact with a well shut in. During circulation, a kill line may be used to "bullhead" or pump fluid back into the well as a method of delivering kill weight mud to the upper portions of the wellbore. Choke line 42 shown at the left side of FIG. 3 typically is filled with clean mud or riser fluid and functions to provide a conduit to circulate out an influx of formation fluid during a kill operation of the well. First hydraulic line 44 and second hydraulic line 46 operate to provide clean water based power fluid to the BOP stack controls.

Figure 4A:
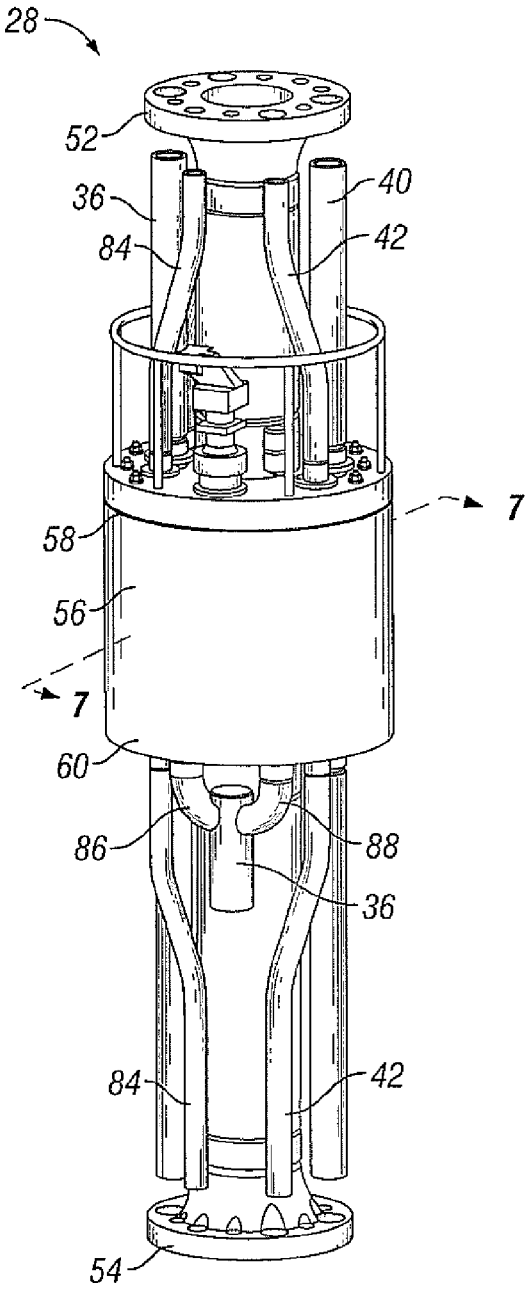
FIG. 4A shows the inline position of the solids processing apparatus.

FIG. 4A shows a solids processing apparatus 28 detached from the drill string portion 35. A housing shell 56 is comprised of an upper end 58 and a lower end 60. Beneath the housing shell 56 may be seen the first drain port 86 and second drain port 88, which join into mud return line 36. Upper flange 52 and lower flange 54 are API rated to be equal to or greater than the riser flange design as they are integral to the integrity of the overall riser string. Further, mud return line 36 also is shown on the left side of FIG. 4A. Seawater power line 40 may, in one embodiment, be constructed of seamless "super duplex" type tubing. A rigid conduit line 84 and choke line 42 also are shown.

Figure 4B:
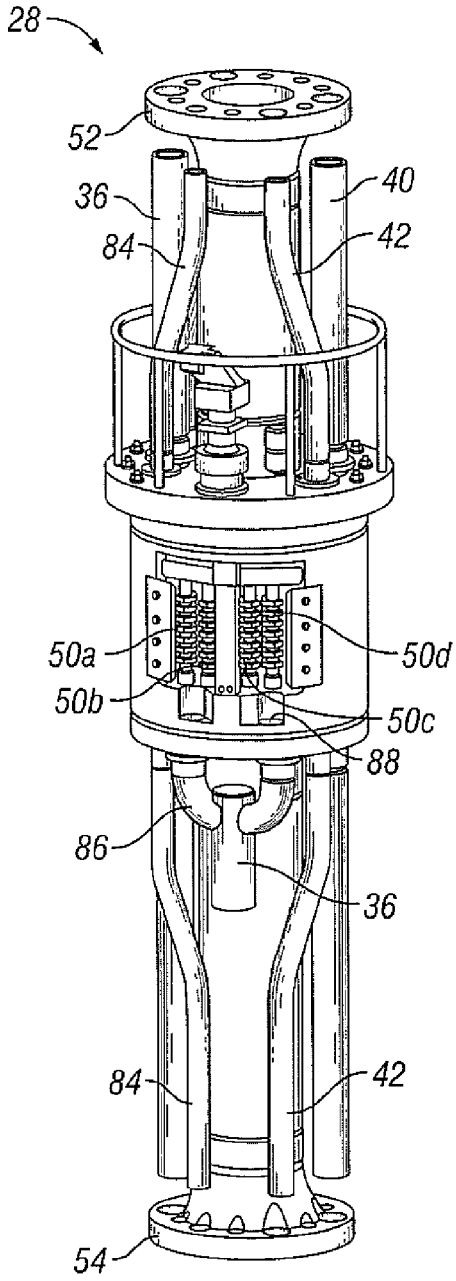
FIG. 4B illustrates some of the interior components of the solids processing apparatus with the housing shell removed.

FIG. 4B shows similar components as that shown in 4A, but in FIG. 4B the housing shell 56 has been removed for a closer examination of the interior components of the solids processing apparatus 28. For example, FIG. 4B reveals first cutter assembly 50*a*, second cutter assembly 50*b*, third cutter assembly 50*c* and fourth cutter assembly 50*d*, which form one unit of the cutter assemblies as further shown herein.

Figure 4C:
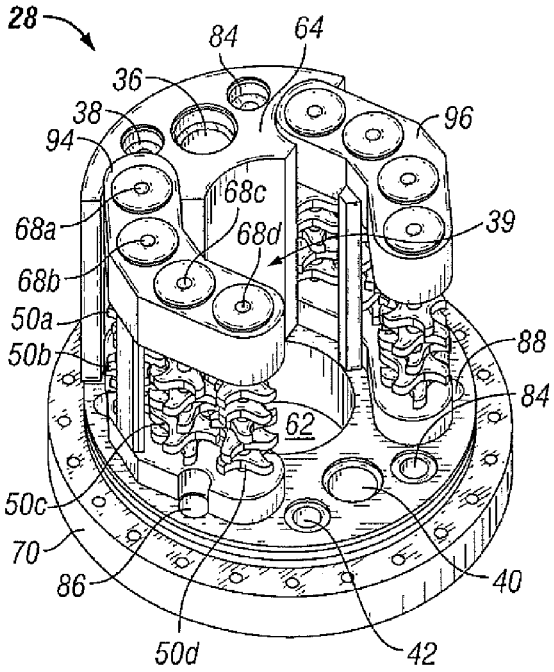
FIG. 4C is a perspective view of the interior of a first embodiment of the solids processing apparatus.

FIG. 4C shows a perspective view of the solids processing apparatus 28 with the housing shell 56 removed and a portion of the inner sleeve cut away for examination of internal components. A central cavity 39 is open and free of mechanical obstruction in the center of the apparatus 28. First cutter assembly 50*a*, second cutter assembly 50*b*, third cutter assembly 50*c* and fourth cutter assembly 50*d* are shown on the left side of FIG. 4C (first cutter assembly 50*a* and 50*b* are partially hidden from view). Further, each cutter assembly 50*a-d* includes respectively, first shaft 68*a*, second shaft 68*b*, third shaft 68*c*, and fourth shaft 68*d* running vertically and generally parallel to each other. The cutter assemblies 50*a-d* are held together in a first cassette 94. Likewise, four more cutter assemblies on the right side of FIG. 4C (not numbered) are held in second cassette 96. The inner sleeve 64 houses mud return line 36, kill line 38 and rigid conduit line 84 (each seen near the top of FIG. 4C). A lower element 70 forms the base of solids processing apparatus 28. First drain port 86 and second drain port 88 receive drilling mud and processed solids after the drilling mud and solids pass through the cutter assemblies on each side of the solids processing apparatus 28. First drain port 86 and second drain port 88 are shown and described in more detail herein with reference to FIG. 5B. Intake aperture 62 is in fluid communication with the central cavity 39. Drilling mud and solids from the wellbore pass through intake aperture 62 and are carried by fluid flow to the cutter assemblies for processing (i.e. size reduction) of the solids, as further described herein. Further, a rigid conduit line 80 and rigid conduit line 84 carry may contain electrical wiring or other cabling. Choke line 42 and seawater power line 40 are shown passing through lower element 70.

Figure 5A:
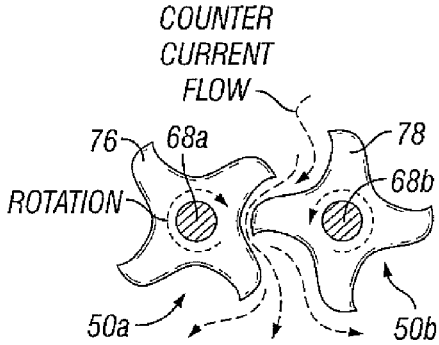
FIG. 5A is a schematic showing the countercurrent flow caused by rotation of the cutter assemblies in opposite direction relative to each other.

In FIG. 5A, a schematic top view of first cutter assembly 50*a* and second cutter assembly 50*b*, detached for illustrative purposes, is applied in one embodiment of the invention. The arrows indicate the opposite rotation of first blade 76 (driven by shaft 68*a*) as compared to second blade 78 (driven by shaft 68*b*). A countercurrent flow pattern is shown. Third cutter assembly 50*c* and fourth cutter assembly 50*d* likewise are paired to form a countercurrent flow pattern in one embodiment of the invention. Other paired cutter assemblies on the right side of FIG. 4C (not numbered) exhibit a similar countercurrent flow pattern among the two paired cutter assemblies within cassette 96. The countercurrent flow pattern is believed to contribute to the efficient and effective movement of drilling mud containing solids from the central cavity 39, through the cutter assemblies (such as 50*a-d*, for example), and into the peripheral annulus region 74 (see FIG. 6) of the solids processing apparatus 28.

Figure 5B:
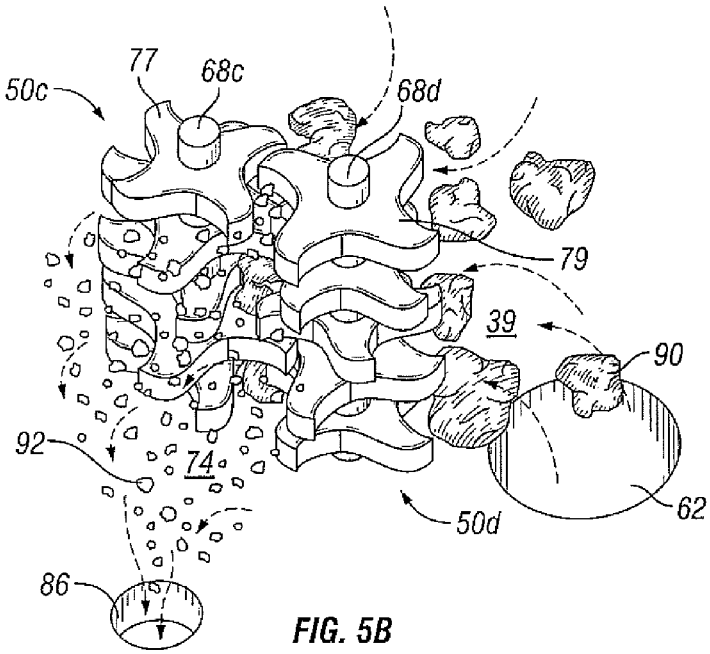
FIG. 5B shows the manner by which solids are reduced in size while moving from the central cavity of the solids processing apparatus to the peripheral annulus region.

FIG. 5B illustrates the movement of solids, such as large solid particle 90, through the intake aperture 62 and from the central cavity 39 through the third and fourth cutter assemblies 50*c-d* to form a smaller solid particle 92 (processed solid), which moves into the peripheral annulus region 74. Third blade 77 and fourth blade 79 are rotated by third shaft 68*c* and fourth shaft 68*d*, respectively, in a countercurrent flow direction, as showed by the arrows of FIG. 5B. This movement is comparable to the movement of first cutter assembly 50*a* and second cutter assembly 50*b* shown in FIG. 5A. Drilling mud and solids are drawn from the central cavity 39 through the solids processing apparatus 28, and exit first drain port 86. Although it has been found that a countercurrent flow pattern assists in moving mud and solids, other flow patterns that are not countercurrent in flow direction could be employed in the practice of the invention. The invention is not limited to any particular flow pattern.

Figure 6:
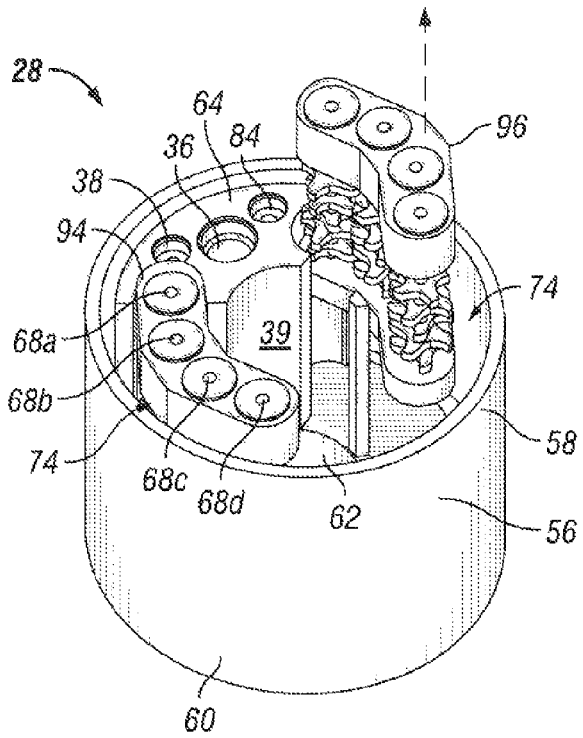
FIG. 6 illustrates the removability of cutter assemblies housed in a cassette.

FIG. 6 illustrates a perspective view of solids processing apparatus 28 with complete housing shell 56, the housing shell 56 having upper end 58 and lower end 60. Housing shell 56 surrounds inner sleeve 64, which forms on its interior surface a hollow, vacant central cavity 39, shown by the arrow in FIG. 6. Central cavity 39 is free from mechanical obstruction and is bounded on the sides by first cassette 94 and second cassette 96. Other structures are essentially the same as set forth herein in connection with FIG. 4C. Second cassette 96 is shown being removed from solids processing apparatus 28 as a single unit, enabling the convenient and efficient maintenance and replacement of cutter assemblies. Likewise, a significant amount of time may be saved in the event the apparatus 28 is removed from the water for maintenance by inserting new cassettes 94, 96 quickly on the rig floor without the necessity of complete rebuilding or reconstruction of cutter assemblies as would be required with a non-modular design. FIG. 6 shows other components seen previously in FIG. 4C.

Figure 7:
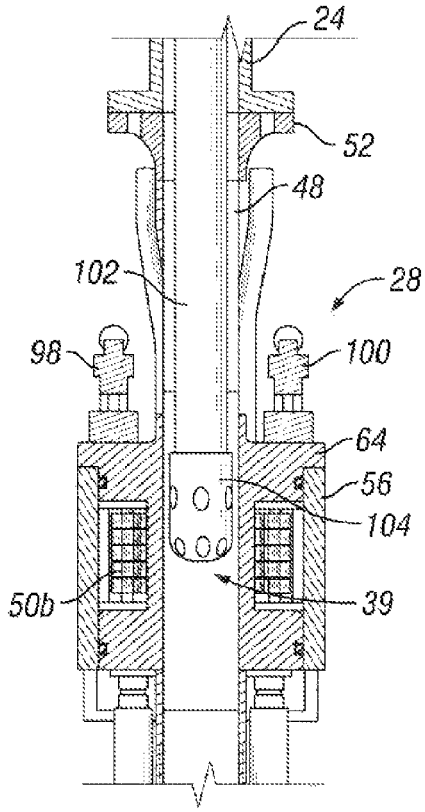
FIG. 7 is a cross-sectional view of the solids processing apparatus of FIG. 4A, revealing the method of washing the interior of the solids processing apparatus with a wash tool extended form the riser into the central cavity of the solids processing apparatus.

FIG. 7 is a cross-sectional view of the solids processing apparatus of FIG. 4A, revealing the method of washing the interior of the solids processing apparatus 28 with a wash tool 102 extended from the riser 24 into the central cavity 39 of the solids processing apparatus. The wash tool 102 with nozzle 104 may be brought down the drill string 35 into the riser 24 and directly into the central cavity 39 to wash gumbo, clay, or other debris directly from the face of the cutter assemblies, such as cutter assembly 50*b*. This maintenance may be critical to the operation of the solids processing apparatus 28, and is made possible by the inline configuration of the solids processing apparatus 28. (i.e. inline with the drill string 29 and riser 24). When cutter assemblies become clogged or jammed, this may be the most effective manner of clearing debris. Also, first drive mechanism 98 and second drive mechanism 100 are shown in FIG. 7. These drives provide power to the respective shafts of the cutter assemblies on each side of the solids processing apparatus 28. One useful manner of powering the driver mechanisms 98, 100 is using hydraulic power from the mudlift pump 30, although other means of power generation are known in the art, and could be employed in the practice of the invention.

Figure 8:
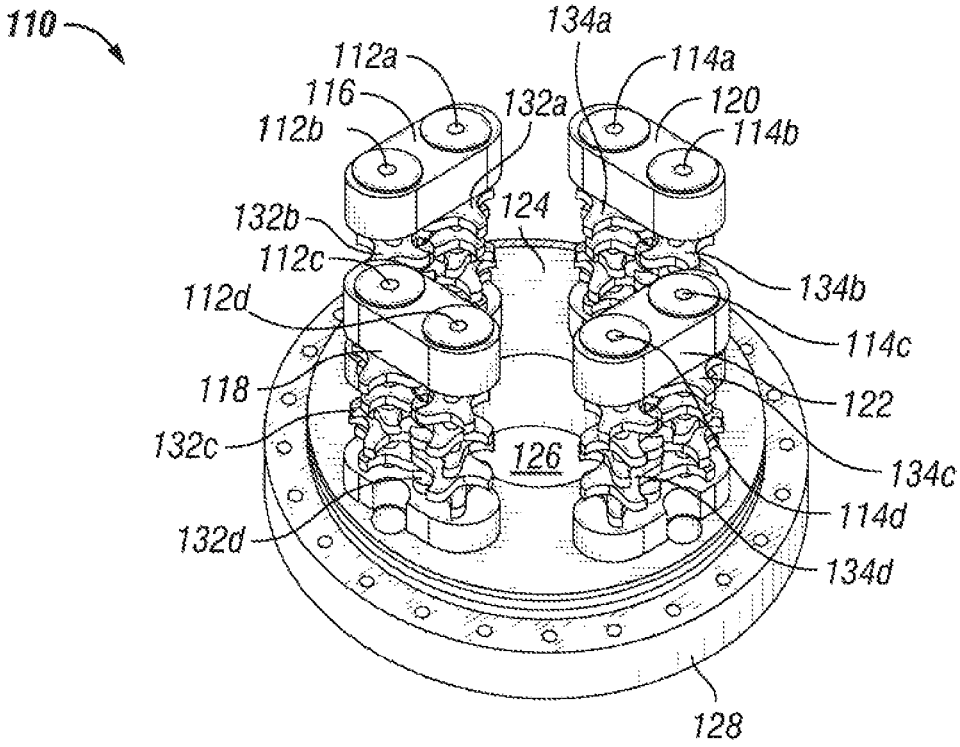
FIG. 8 shows an alternate embodiment of the solids processing apparatus with an alternate cassette arrangement.

FIG. 8 reveals a second embodiment. 110 of the invention, in which a different cutting assembly and cassette arrangement is shown in this embodiment, cutter assemblies 132*a-b* (with respective shafts 112*a-b*) are paired in a first cassette 116, while cutter assemblies 132*c-d* (with respective shafts 112*c-d*) also are paired in second cassette 118, but spaced apart from cutter assemblies 132*a-b*. Likewise cutter assemblies 134*a-b* (with shafts 114*a-b*) form third cassette 120 and cutter assemblies 134*c-d* (with shafts 114*c-d*), forming fourth cassette 122, also are shown in paired configuration. Some embodiments of the invention may benefit from the arrangement shown in FIG. 8, which employs four total cassettes instead of the two cassette arrangement (first embodiment) of FIGS. 4C and 6. A central cavity 124 is free from obstruction, and it receives drilling mud and solids through intake aperture 126. Lower element 128 supports the underside of the solids processing apparatus 110. The flow characteristics of the second embodiment 110 (as compared to the first embodiment of solids processing apparatus 28 of FIG. 4C) may be more suited for certain specific operating conditions or certain particular geological properties of the drilled solids, as could become apparent from testing or practical use.

The solids processing apparatus is designed to avoid having solids (or "cuttings") reach the mudlift pump 30 that are larger than about 1½ inch×½ inch×½ inch in dimension, as this dimension is the maximum solid particle dimensions that most suitable pumps of this type are designed to accommodate. Cutting assemblies in the solids processing apparatus 28 typically will be capable of shearing anything larger than these dimensions. Drilled cuttings smaller than the required minimum pass through the solids processing apparatus 28. The size of processed solids 92 may be reduced to approximately ⅓ or less of the diameter of piping or valves that the cuttings are to pass through in the practice of the invention. After passing through the solids processing apparatus 28, drilling mud and processed solids 92 may be delivered to the mudlift pump 30 and then pumped to the surface through a riser mounted, mud return line 36. Valves (not shown) may be used to control the flow from the solids processing apparatus 28 into the mudlift pump 30.

The mudlift pump 30 may be diaphragm-type pump in some embodiments. It is believed to be desirable to employ a six-chamber (80-gallon) diaphragm pump powered by seawater pumped from the surface. It is desirable that the mudlift pump 30 employed be a positive displacement type pump with independently controlled suction and discharge valves. Because each chamber may be operated independently, the mudlift pump 30 may operate as two triplex pumps, a quintaplex, a quadraplex, a triplex, a duplex or as a single chamber pump. This ability results in a desirable redundancy when the pump is operating at less than maximum, capacity.

In some instances, the mudlift pump 30 provides a maximum rated flow rate of 1800 gallons per minute with all chambers being operational. The pump typically will have two major modes of operation: (1) a constant inlet pressure mode, which is employed for most operations, and (2) a constant rate mode used for certain well control operations.

The solids processing apparatus 28 is employed to achieve size reduction of wellbore solids and cuttings to assure that neither the suction line to the mudlift pump 30 (suction line not shown) nor the discharge flow entering the mud return line 36 from the mudlift pump 30 will suffer a blockage or undesirable plugging event. The solids processing apparatus 28, 110 typically is physically located between the subsea rotating device (SRD) and the lower marine riser package in the practice of the invention. However, it is possible that the solids processing apparatus 28, 110 could be located in another position, such as inside or within the mudlift pump 30. The solids processing apparatus 28, 100 typically receives controls and hydraulic power via a signal carried by umbilicals (not shown).

In one embodiment, the solids processing apparatus 28 will have two redundant fluid pathways, so that the entire flow may proceed through either path (i.e. through either cassette in the first embodiment) in the event that one entire cassette or cutting assembly becomes plugged with debris or becomes jammed. Further, the cutter assembly preferably will have the ability to reverse drive direction to clear jams.

During DGD operations, the drilling mud returns flowing up the annulus will be stopped from flowing up the marine drilling riser at the subsea rotating device 26. The subsea rotating device 26 seals the annulus inside the marine drilling riser 24 while allowing the drill pipe (not shown) to pass through and rotate. This will cause the drilling mud returns to seek a different path out of the riser 24.

In one embodiment, the solids processing apparatus 28 is positioned inline with the riser 24. The solids processing apparatus 28, 110 usually will be located directly below the SRD and may have windows (not shown) in the riser wall that will allow drilling returns to exit. The cutting assemblies will be located on the solids processing unit 28, 110 in a vertical orientation arranged inner sleeve below the riser.

In the practice of dual gradient drilling as described herein, a drill string valve (not shown) may be employed to prevent the drill pipe from u-tubing in the well when circulation is stopped. The drill string valve may be employed in several drill pipe sizes and it is generally employed just above the bottom hole assembly. It is capable of use in wells in 10,000 feet of water and up to 35,000 TVD with 18.5 pounds per gallon mud.

A suitable and advantageous material for construction of the blades in the solids processing apparatus 28, 110 is a non-magnetic high strength corrosion resistant alloy. One such alloy that may be employed is Monel® nickel alloy manufactured by Special Metals Corporation of Huntington, W. Va. This alloy resists "sticking" of the clays and gumbo soil of the geology of the United States Gulf coast, on the metallic surfaces of the blades, which assists in preventing clogging or jamming of the solids processing apparatus 28, 110. In practice, blades may process gumbo, asphalts (tar), cement, shale, rock, elastomers, plastics, metal (such as float shoes) and other wellbore materials experienced during drilling operations. Blades are constructed of materials and surface treatments to accommodate debris and drilling mud.

The solids processing apparatus 28, 110 may achieve a flow rate of as much as 1800 gallons per minute through each flow path (each cassette). In that manner, even if one cutter assembly is clogged or otherwise inoperable, there will be enough flow capacity through the other side(s) or other cassettes of the solids processing apparatus 28, 110 to manage the entire flow volume. This feature is particularly valuable to avoid the need to pull the entire apparatus 28, 110 from the water for remedial operations, which is time consuming and costly.

In the practice of the invention, the solids processing apparatus 28, 110 typically will be capable of being passed through a drilling rig rotary table of about 60.5 inches with a 59 inch inside diameter diverter housing. The maximum outside diameter of the solids processing apparatus 28, 110 is no greater than 58 inches in one useful embodiment of the invention.

The cutter assemblies may be supplied with a sealed bearing and gearbox design in a pressure compensated oil bath to prevent undesirable fluid ingress at water depth. The pressure compensating system usually will have a slightly higher pressure than ambient in order to ensure that any oil leak will occur from the sealed cavity to the drilling mud returns.

The following specifications are examples of useful sizes and parameters for the components and lines that may be employed in the drilling system, which may be recognized by persons of skill in the art of well drilling. However, the invention is not limited to the parameters listed:

Choke & Kill Lines
Pipe size to be 6½" OD×4½" ID
15,000 psi working pressure
$H_2S$ Service
Minimum corrosion allowances=0.05 inch
Seawater Power Fluid Line (Filtered and Possibly Treated Seawater)
Pipe size 7½" OD×¾" wall
7,500 psi working pressure
Mud Return Line (Mud and Cuttings)
Pipe size to be 7½" OD×¾" wall
7,500 psi working pressure
Minimum corrosion allowances=0.05 inch
Hydraulic Conduit Line
Two (2) lines, size to be 2⅞" OD×0.276" wall
5,000 psi working pressure One advantage of the inline configuration of the solids processing apparatus 28, 110 is that it is possible to efficiently and quickly clean mud and debris from the inside of the apparatus using a wash tool 102 that is lowered through the riser 24 and placed through the SRD and directly into the central cavity of the apparatus 28, 110. A high pressure nozzle 104 of the wash tool 102 may be employed to clean and flush the blades as high pressure water is jetted through to the surface of the blades in the peripheral annular region. This is a highly effective and efficient method of cleaning the blades of the solids processing apparatus 28, 110, and is enabled by direct inline placement of the apparatus 28, 110 in alignment with the riser 24.

Discharge line routing is made with sweeping bends where possible, as sharp 90 degree bends and 180 degree turns preferably are avoided in the practice of the invention. Layout of piping shall minimize the number of fluid direction changes, as excessive bends will result in solids settling and high pressure drops in the pipe. The cutter assemblies may be driven by a bidirectional variable speed drive. If the drive power becomes unable to provide the required torque at the given rotation speed or the pressure drop across the cutter assemblies exceeds a preset value, the controls may slow the revolutions per minute (rpm) or switch direction of the cutters to clear the jam. Once the jam is cleared or an excessive hydraulic drive pressure is experienced in the reverse direction, the blades then will then rotate in the processing direction again at a reduced speed and higher torque to process any additional material that may be causing the jam.

Corrosion control for the apparatus of the invention may be provided by appropriate material selection, coating systems and cathodic protection, with reference to SSM-SU-54.11: General Requirements for Subsea Equipment.

In the practice of the invention, drilling fluids listed herein preferably will be compatible with equipment elastomers at operating temperatures and pressures. Pressure design of the system considers a maximum static mud weight of about 18.3 ppg. Additional consideration for all designs where applicable take into account friction pressures at expected prevailing flow rates.

Specific mud compositions that are useful in the practice of the invention are as follows:

(a) 10% NaCl with 30% Glycol +/− for hydrate suppression to 35° F. (2° C.). This mud system is particularly useful for drilling surface hole intervals where the fracture gradient is low. It provides hydrate suppression with a low salt content. The mud density for this formula is approximately 9.5 ppg.

(b) 26% sodium chloride with polymers and glycols. The mud weight ranges from 12.0 ppg to 16.0 ppg. This formulation is used for drilling subsalt wells where synthetic mud cannot be used below the salt because of low fracture gradients.

(c) 20-25% Calcium Chloride. Mud density ranges from 12.0 ppg to 16.0 ppg.

(d) 20-25% Potassium Chloride. Mud density ranges from 12.0 ppg to 16.0 ppg.

(e) $C_{16}$-$C_{18}$ IO (Internal Olefin) mud system. Mud density ranges from 14.0 ppg to 18.3 ppg.

(f) Low salinity lignite/lignosulfonate system. Weighted up to 18.3 ppg.

(g) Sodium silicate mud system. Weighted 12 to 18.3 ppg.

(h) Weighting materials may include barite, calcium carbonate and hematite.

Additional embodiments of the invention are contemplated by this disclosure, and other embodiments illustrated or described herein but not specifically recited are within the scope of the claimed invention.

What is claimed is:

1. A system for processing drilled solids within a body of water, the body of water having an upper water surface and a lower mudline surface, the system comprising:

a riser having a drill string and extending below the water surface, the riser being filled with a first fluid having a first density, a wellbore extending below the mudline surface, the wellbore being filled with a second fluid of a second density, wherein the second density is greater than the first density, a fluid separation mechanism in communication with the riser and the wellbore, the fluid separation mechanism being adapted for maintaining separation and differential density between the first and second fluids, a mud lift pump, and a solids processing apparatus connected to the mud lift pump, the solids processing apparatus having a central cavity, the central cavity of the solids processing apparatus being positioned in vertical alignment with the riser and drill string, the solids processing apparatus being adapted for receiving drilled solids in the central cavity and reducing the particle size of the drilled solids to form processed solids, wherein the solids processing apparatus further comprises:

(a) a load bearing inner sleeve surrounding the central cavity, the inner sleeve being configured for receiving and transferring substantial riser/drill string load forces, (b) a housing shell positioned circumferentially outside of the inner sleeve, (c) wherein a peripheral annulus region is provided between the inner sleeve and the housing shell, (d) a first cutter assembly positioned in the peripheral annulus region, and (e) an intake aperture in communication with the central cavity, the intake aperture being adapted for transferring drilled solids to the central cavity of the solids processing apparatus.

2. The system of claim 1 wherein the solids processing apparatus comprises a pressure rating at least as great as the pressure rating of the riser.

3. The system of claim 1 further comprising a drain port connecting the solids processing apparatus to the mud lift pump wherein processed solids are transported from the solids processing apparatus to the mud lift pump through the drain port.

4. The system of claim 1 wherein the first cutter assembly comprises a first shaft, further wherein a second cutter assembly is provided comprising a second shaft, wherein the first and second shafts are aligned generally parallel.

5. The system of claim 4 wherein the first and second shafts of the first and second cutter assemblies are configured for counter-rotation.

6. The system of claim 4 wherein the first and second cutter assemblies are mounted in a first cassette.

7. The system of claim 6, wherein a second cassette is provided in the peripheral annulus region of the solids processing apparatus.

8. The system of claim 7 wherein the first and second cutter assemblies are powered by a hydraulic mechanism, the hydraulic mechanism being connected to the mud lift pump.

9. The system of claim 1 wherein the solids processing apparatus is capable of sustaining at least 3.5 million pounds of axial load, wherein axial load forces are transferred through the inner sleeve.

10. An apparatus for processing solids within a body of water in association with a riser and drill string, the apparatus comprising:

a solids processing apparatus having a central cavity, the central cavity of the solids processing unit being positioned in vertical alignment with the riser and drill string, the solids processing apparatus being adapted for receiving solids within the central cavity and reducing the particle size of the solids to form processed solids, wherein the solids processing apparatus further comprises:

(a) a load bearing inner sleeve surrounding the central cavity, the inner sleeve being configured for receiving and transferring substantial riser/drill string load forces, (b) a housing shell positioned circumferentially outside of the inner sleeve, (c) wherein a peripheral annulus region is provided between the inner sleeve and the housing shell, (d) a first cutter assembly positioned in the peripheral annulus region, and (e) an intake aperture in communication with the central cavity, the intake aperture being adapted for transferring drilled solids to the central cavity of the solids processing apparatus.

11. A method of processing solids within a body of water, the body of water having a water surface and a mudline surface, wherein a riser extends below the water surface, the riser being filled with a first fluid having a first density, with a wellbore extending below the mudline surface, the wellbore being filled with a second fluid of a second density, wherein the second density is greater than the first density, a fluid separation mechanism being connected to the riser and in fluid communication to the wellbore, the fluid separation mechanism being adapted for maintaining a differential density between the first and second fluids, the method comprising the steps of:

(a) providing a solids processing apparatus having a central cavity, the solids processing apparatus being positioned in vertical alignment- with the riser, further wherein the solids processing apparatus is positioned to accommodate the extension of a tool downward through the riser and into the central cavity of the solids processing apparatus, (b) transporting solids from the wellbore to the interior space of the solids processing apparatus, (c) reducing the size of the solids to produce processed solids, (d) expelling processed solids from the solids processing apparatus, (e) providing a mud lift pump, (f) transferring the processed solids to the mud lift pump, (g) pumping the processed solids to the water surface, and (h) extending a wash tool through the riser into the central cavity of the solids processing apparatus, and (i) washing solids from the interior of the solids processing apparatus.

* * * * *